US006343479B1

(12) United States Patent
Merritt

(10) Patent No.: US 6,343,479 B1
(45) Date of Patent: Feb. 5, 2002

(54) POTABLE WATER COLLECTION APPARATUS

(76) Inventor: Thomas Merritt, 11357 W. Biscayne Canal Rd., Miami, FL (US) 33161

( * ) Notice: Subject to any disclaimer, the term of this patent is extended or adjusted under 35 U.S.C. 154(b) by 0 days.

(21) Appl. No.: 09/681,741

(22) Filed: May 30, 2001

(51) Int. Cl.[7] ..... F25D 21/14
(52) U.S. Cl. ..... 62/285; 62/274
(58) Field of Search ..... 62/291, 274, 285, 62/288

(56) References Cited

U.S. PATENT DOCUMENTS 4,135,370 A * 1/1979 Hosoda et al. ..... 62/274
5,259,203 A * 11/1993 Engel et al. ..... 62/291
5,517,829 A * 5/1996 Michael ..... 62/272
6,029,461 A * 2/2000 Zakryk ..... 62/291

* cited by examiner

*Primary Examiner*—William E. Tapolcai
*Assistant Examiner*—Mohammad M. Ali

(57) ABSTRACT

An apparatus for transferring water vapor into potable water, by using a vapor compression refrigeration system which includes both a water-cooled condenser and an air-cooled condenser. The water-cooled condenser is located in the refrigerant fluid path between the exit of the compressor and the inlet of the air-cooled condenser where it behaves as a desuperheater. The water exiting the condenser, containing the superheat from the refrigerant, is transferred through conduit to a water to air heat exchange means having an open cell ligament structure, wherein as the water falls through it, the water is cooled by the evaporation of a portion of the water by an air stream also passing through it. The open cell ligament structure coincidently acts as a filter for the air stream. The filtered air stream containing added sensible and latent heat is put in contact with the exterior surface of the evaporator portion of the vapor compression refrigeration system where heat is removed causing the water vapor to condense on the evaporator surface and fall and collect in a suitable container at the bottom of the evaporator where it is further treated and purified by a germicidal lamp.

6 Claims, 3 Drawing Sheets

POTABLE WATER COLLECTION APPARATUS

BACKGROUND OF INVENTION

The present invention relates to an improved apparatus for transforming water vapor into potable water, and more particularly for obtaining drinking quality water by the formation of condensed water vapor upon a surface maintained at a temperature substantially below the dew point for a given relative humidity condition. The surface upon which the water vapor is condensed is kept below the dew point by means of circulating refrigerant through a closed fluid path which includes refrigerant compression and condensing means.

U.S. Pat. No. 5,301,516 to Poindexter discloses a potable water collection apparatus comprising refrigeration means to maintain a cooling coil at a temperature below the dew point whereby condensed water vapor may form. U.S. Pat. Nos. 5,149,446 and 5,106,512 to Reidy, also disclose refrigeration means to accomplish the same result. Many earlier prior art examples exist within the public domain. However, all of these most recent and previous examples of prior art pose a similar deficiency or shortcoming, specifically, the lack of the ability to cause water vapor to condense in an economical fashion during conditions when the ambient wet bulb and dry bulb temperatures indicate very low relative humidity or less than ideal conditions. The prior art examples, being designed to produce water economically only in an environment containing an ideal temperature and relative humidity, encounter difficulty producing water in an indoor air conditioned environment and consequently they must either be located out of doors or, if located indoors, they must have outside air ducted to them as disclosed in Reidy, U.S. Pat. No. 5,149,446. In U.S. Pat. No. 5,106,512 also to Reidy with reference to FIG. 5, which is a reproduction of a rudimentary psychometric chart, it is disclosed that all water collection takes place at 90 percent relative humidity. What is not revealed by the same illustration is that very little moisture actually exists even at 100 percent relative humidity when the dry bulb temperature is below 65 degrees Fahrenheit (F). In regions where relative humidity averages 20 percent or less year round, regardless of the ambient temperature the dew point is well below the freezing point (32 degrees F). Therefore, while possessing the capability to produce water economically only under the most ideal temperature and relative humidity conditions, for all practical purposes the geographical regions wherein the prior art devices can operate are severely limited. The novel water collection apparatus disclosed herein will overcome these deficiencies and will provide an economical method and means to provide pure unadulterated microbiologically safe drinking water under a wide range of ambient conditions present in differing climatic regions, including regions with conditions which are heretofore considered undesirable for such an apparatus, such as dessert regions. Further, the instant invention will provide an economical means to create pure safe drinking water in regions where water is plentiful yet of undesirable quality or even unsafe to drink, thereby overcoming the shortcoming in the prior art and providing a much needed solution to the water quality problems which exist worldwide in the present day.

SUMMARY OF INVENTION

It is the object of the present invention to provide a novel means and method for condensing and collecting water for drinking purposes. It is a further object of the invention to provide a highly economical means and method for producing pure drinking water from water vapor. It is yet a further object of the invention to provide a unique departure from conventional refrigeration techniques which are normally employed in water collection apparatus. These and yet further object are fulfilled by employing sophisticated heat and superheat management techniques within a vapor compression refrigeration mechanism. Included within the vapor compression refrigeration component of the invention is a refrigerant de-superheating means further including primary and secondary heat exchange means. During operation, that portion of heat known as superheat is maintained within the system and specifically manipulated in order to create a controlled high relative humidity condition in a region existing at or near the surface of the evaporator component in the vapor compression refrigeration mechanism. The direct result of the manipulation of superheat within the refrigeration system, more specifically the transformation of superheat into latent heat, supplying the latent heat back into the circulating refrigerant, then converting the latent heat again back into superheat, is a high relative humidity condition coincidental with an ideal temperature as well. This novel technique, more accurately described in the detailed description, has the effect of creating the most desirable conditions for the condensation of water vapor during an ambient condition regardless of the prevailing temperature or relative humidity. In addition, the aforementioned novel superheat manipulation technique is accomplished with no adverse effects upon the refrigeration mechanism with respect to entropy or enthalpy, rather providing a positive effect whereby typical pressures are consistently exhibited.

Further included is a means for containing collected water, various operational controls and a germicidal control means.

DETAILED DESCRIPTION

Figure 1:
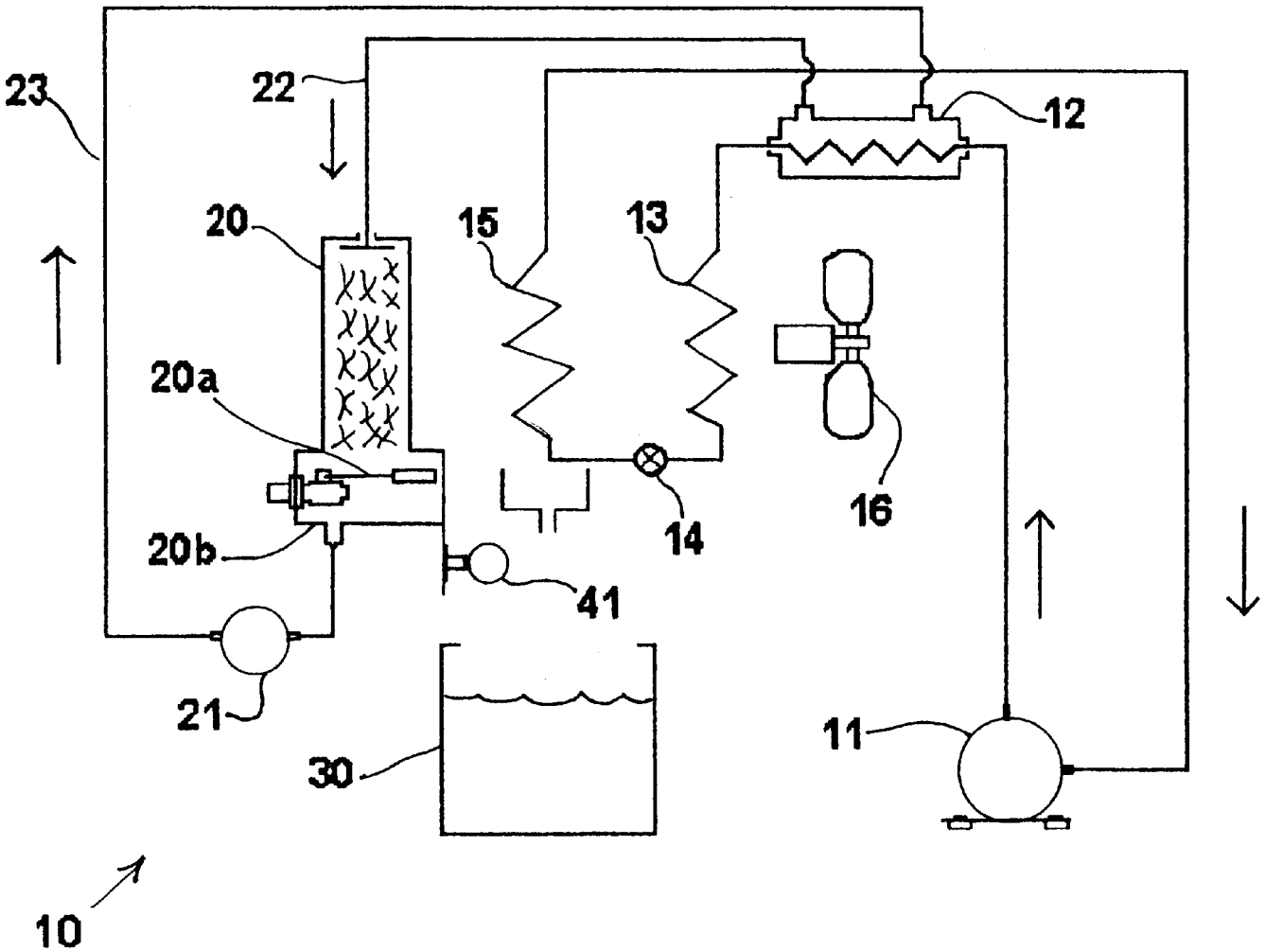
FIG. 1 is a schematic representation of the preferred embodiment of the instant invention including the working components of the novel refrigeration mechanism.
Figure 2:
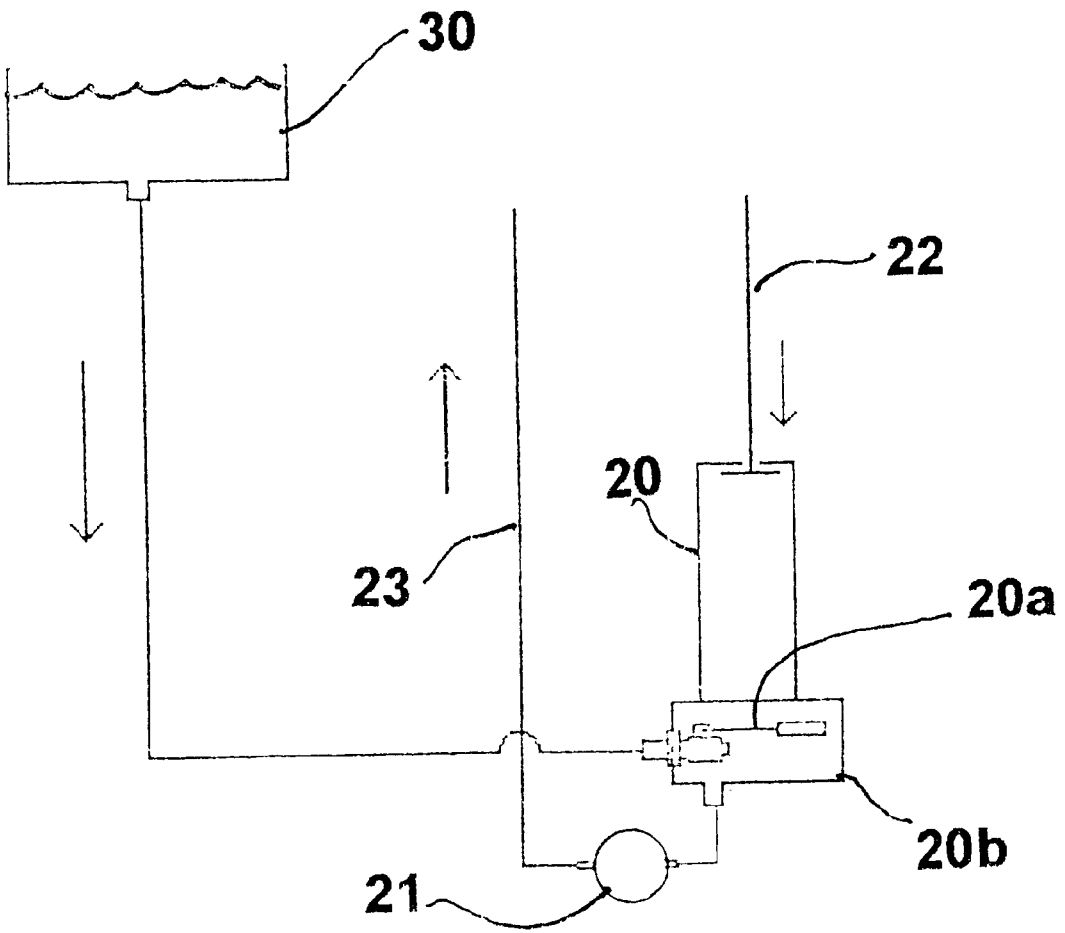
FIG. 2 is a schematic representation of an alternate embodiment of the invention.

With reference to FIG. 1 in which the inventive system 10 is drawn in schematic form, a vapor compressor 11 is in fluid communication with de-superheater 12. A refrigerant is caused to flow out of the compressor, into the de-superheater where water removes the superheat. The de-superheated refrigerant now flows to condenser 13 wherein the remainder of the heat content of the refrigerant is removed, thereby causing the refrigerant to completely condense into liquid form. The liquid refrigerant now passes through metering device 14 into a region of low pressure within evaporator 15 wherein the liquid refrigerant now boils at a predetermined pressure. As the refrigerant boils at a temperature relative to whichever pressure is predetermined, it absorbs heat from the air forced across its exterior surface by fan 16. The preferred pressure within the evaporator will normally be equal to a temperature below the dew point of atmospheric conditions present at or near the region of the exterior surface of the evaporator. Any moisture or humidity contained within the air flowing across the exterior surface of the evaporator 15 is condensed into liquid form and falls by gravity into container 30 for storage. Water exiting from de-superheater 12 passes through conduit 23 into heat exchange means 20, into sump 20A, through pump 21 and back into the de-superheater through conduit 22, continuously circulating through this prescribed fluid path. As the heat-laden water passes through heat exchanger 20 it falls through an open cell ligament structure medium wherein it is cooled by air simultaneously causing a certain percentage of the water to evaporate. The heat removed from the water is now in the form of latent heat contained within the vapor form of water by virtue of the location of heat exchanger 20, which also serves as an air filtering means, is borne into the air stream flowing across the exterior surface of evaporator 15. The refrigerant within evaporator 15 absorbs the latent heat, which was originally superheat, back into the system. The immediate effect of this technique is to create an ideal temperature and humidity level proximate to the water forming surfaces upon the exterior of the refrigerant evaporator. Since the water flowing in and out of de-superheater 12 and through the heat exchanger will evaporate continuously at a variable rate, it must be replaced continuously. The water level in the sump 20*a* of heat exchanger 20 is kept at a pre-determined level by float valve 20*b* which is in fluid communication with an external source of water. This external source maybe ordinary tap water or water from various other sources, including water of uncertain potability. With reference to FIG. 2, the sump 20*a* is in fluid communication with a cistern 40. Other means of providing cooling water to the de-superheater maybe substituted.

In essence the above described refrigeration technique embodies a split condenser whereby a first distinct segment, herein referred to as de-superheater 12 is water cooled, and a second distinct segment herein referred to as condenser 13 is air cooled. It is to be understood that the air-cooled second segment is sized accordingly in order to accommodate the entire heat load under all conditions. This load sizing is important given the changing environmental conditions, which may be encountered. That is to say, condenser 13 is capable of rejecting the entire heat load non inclusive of de-superheater 12 whether the device is operating in conditions, which are extremely warm, with very high relative humidity conditions, or in cool dry conditions. Very little water evaporation at heat exchanger 20 will occur while operating in warm high humidity conditions; therefore very little sensible heat can be rejected from the de-superheater. All the heat load absorbed by the evaporator will originate solely form the environmental conditions in which a device is operated. Under this condition the circulating water pump is to be switch off, and by virtue of the sizing of condenser 13 no adverse effect with respect to entropy or enthalpy will be noticed, with water collection proceeding at a high rate. When operating in a period or a region when relative humidity is very low, the circulating pump is switched on and by virtue of the environmental conditions present a greater amount of evaporation of water exiting from de-superheater 12 takes place within heat exchanger 20, therefore latent heat in the form of water vapor is released into the air stream flowing across evaporator 15 and, surprisingly similar to the operation during the high heat high humidity conditions, water collection remains at a high rate. This is true regardless of the ambient temperature, because of the combination of a relatively high temperature of the water entering heat exchanger 20 and the low relative humidity of the ambient air.

The method described herein has the effect of providing consistently normal pressures within the refrigeration system across a wide range of operating conditions while providing a means for high rate water collection under a wide range of environmental conditions.

When the water in container 30 reaches a predetermined level the device automatically turns off. With reference to FIGS. 1 and 2, germicidal lamp 41 by virtue of its location, illuminates the region where water is being condensed as well as the interior of container 30 wherein the water is stored.

Figure 3:
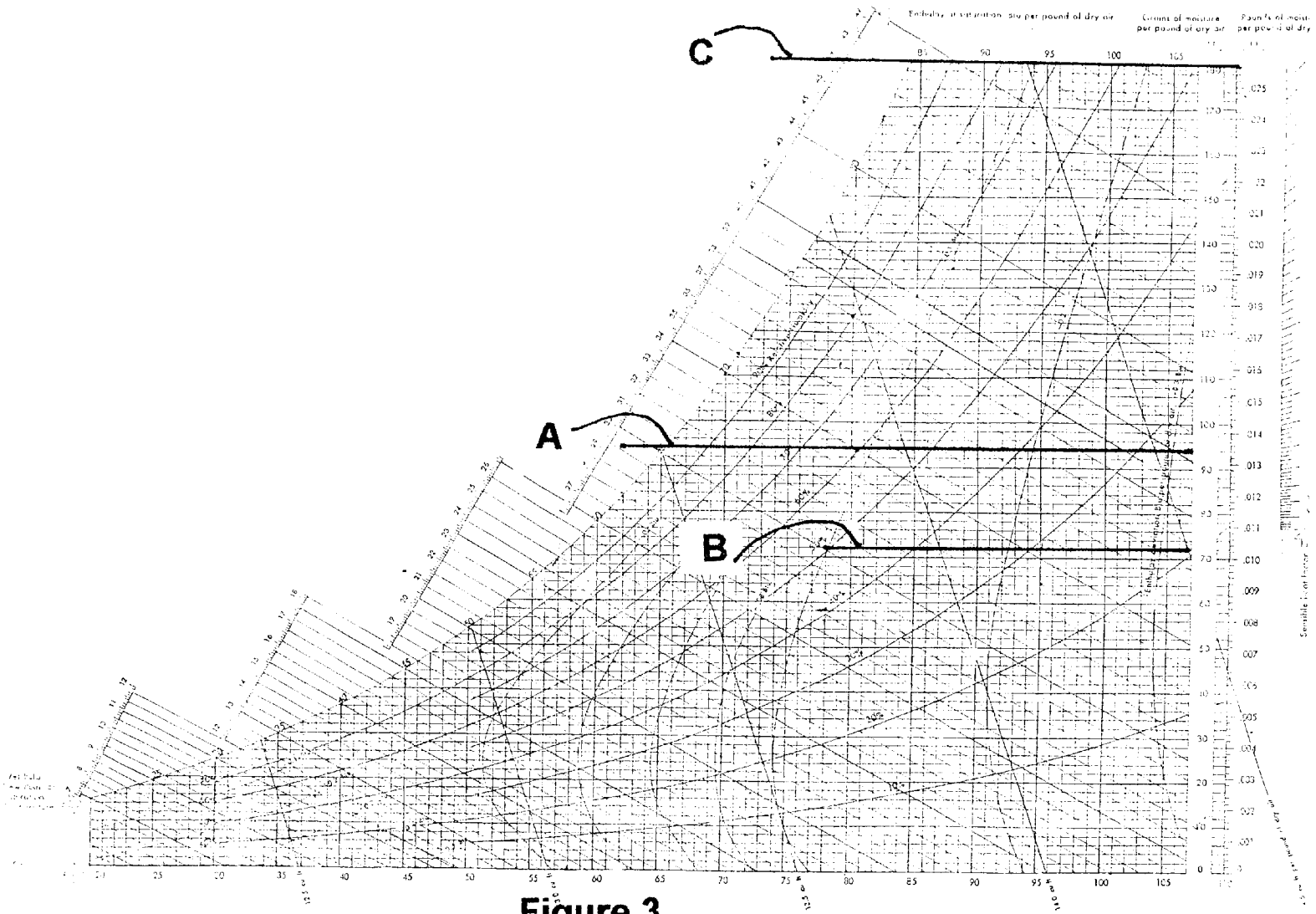
FIG. 3 is a standard Psychometric chart with specific marked points of reference.

With reference to FIG. 3, a bold line defined by the label "A" is drawn across the chart at the 100 percent humidity condition for 65 degrees Fahrenheit. On the right side of the chart where the amount of moisture per pound of dry air is present as indicated, it illustrates that only 94 grains of moisture per pound of dry air is available at 100 percent relative humidity. For all practical purposes the condensing of water vapor under this condition is extremely uneconomical. At 65 degrees Fahrenheit with 50 percent relative humidity, a more realistic condition, it is shown by line "B" that only 72 grains of moisture per pound of dry air is present under this condition, a scenario that is even less desirable. The most ideal condition for the condensation of water vapor is at the point where a line marked "C" is drawn across the chart. Here it is illustrated that 180 grains of moisture per pound of dry air is available. By employing the novel techniques of superheat management described above, this most ideal condition is present at all times during the operation of the invention.

Accordingly, while a preferred embodiment of the present invention is shown and described herein, it is understood that the invention maybe embodied otherwise than as herein specifically illustrated or described and that within the embodiments certain changes in the detailed construction, as well as the arrangement of the parts, may be made without departing from the principles of the present invention as defined by the appended claims.

What is claimed is:

1. In an apparatus employing a mechanical vapor compression refrigeration mechanism for the conversion of water vapor into potable water, said mechanism including improvements comprising, a) refrigerant condensing means disposed within said refrigeration mechanism, said means divided into at least two separate segments, said separate segments in fluid communication, said segments comprising a first segment as water cooled and a second segment being air cooled, said condensing means including a fluid inlet in communication with refrigerant compression means of said refrigeration mechanism, whereby pressurized gaseous refrigerant will enter said first segment, and a fluid outlet whereby liquid refrigerant will exit from said second segment, said outlet in communication with refrigerant evaporator element of said refrigeration mechanism, and b) a water to air heat exchange means, said means in fluid communication with said water cooled first segment through fluid conduit means, said heat exchange means disposed proximate to said refrigerant evaporator element of said refrigeration mechanism, whereby heat transferred by water from said water cooled segment is converted to latent heat by virtue of evaporation of a portion of said water passing through said heat exchange means, whereupon said evaporated portion of said water in combination with water vapor of ambient condition will condense upon the exterior surface area of said evaporator, simultaneously resulting in a reduction of temperature of said water, a high humidity atmospheric condition proximate to said evaporator element, and the re-entry of a portion of said latent heat into circulating refrigerant within said refrigeration mechanism.

2. The apparatus recited in claim 1 wherein said water to air heat exchange means is coincidentally an air filtering means, whereby said proximate evaporator element is protected form airborne particulate matter during operation.

3. The apparatus recited in claim 2 wherein said heat exchange means includes a water reservoir for the purpose of containing a reserve quantity of water.

4. The apparatus recited in claim 3 further including submersible water pump means disposed within said reserve quantity of water, said pump including an outlet in fluid communication with said water cooled first segment.

5. The apparatus recited in claim 3 further including electrical means to maintain a predetermined water level in said reservoir whereby said submersible pump means is protected from a low water condition.

6. In an apparatus employing a vapor compression refrigeration mechanism for the conversion of water vapor into potable water, said mechanism including improvements comprising, a) a vessel containing a coiled tubing of compressed refrigerant, said vessel having an inlet and an outlet for the purpose of circulating water through said vessel, said coiled tubing in fluid communication with outlet of compressor means and inlet of air-cooled condenser means of said vapor compression refrigeration mechanism;

b) a water to air heat exchange means having a top and a bottom, said bottom having accumulation means, said top in fluid communication with said outlet of said vessel, said water to air heat exchange means situated so that forced air passes through said heat exchange means before passing through evaporator means of said refrigeration mechanism, whereby said forced air's ability to carry water vapor is maximized before contacting the exterior surface of said evaporator;

c) a pump means located in said accumulator in fluid communication with said inlet of said vessel, whereby water is pumped from said accumulator through conduit to inlet of said vessel, exiting said vessel through conduit to top of said water to air heat exchange means, passing down said heat exchange means and collecting in said accumulator.

* * * * *